United States Patent [19]

Grecksch et al.

[11] Patent Number: 5,029,763

[45] Date of Patent: Jul. 9, 1991

[54] METHOD AND APPARATUS FOR TRANSFERRING PACKAGES FROM WINDING STATIONS OF A TEXTILE WINDING MACHINE

[75] Inventors: Hans Grecksch, Monchengladbach; Josef Bertrams, Wegberg; Wolfgang Loers, Monchengladbach, all of Fed. Rep. of Germany

[73] Assignee: W. Schlafhorst & Co., Fed. Rep. of Germany

[21] Appl. No.: 464,557

[22] Filed: Jan. 16, 1990

Related U.S. Application Data

[63] Continuation of Ser. No. 241,060, Sep. 6, 1988, abandoned.

[30] Foreign Application Priority Data

Sep. 5, 1987 [DE] Fed. Rep. of Germany ..... 3729776

[51] Int. Cl.[5] ..... B65H 67/04

[52] U.S. Cl. ..... 242/35.50 A

[58] Field of Search ..... 242/35.5 A, 35.5 R, 242/18 R, 36, 37 R, 39; 57/266, 268, 270, 271, 281

[56] References Cited

U.S. PATENT DOCUMENTS

| | | | |
|---|---|---|---|
| 3,879,925 | 4/1975 | Yoshizawa et al. | 242/35.5 A X |
| 3,988,879 | 11/1976 | Franzolini et al. | 242/39 X |
| 4,157,792 | 6/1979 | Wyckhuys | 242/35.5 A X |
| 4,175,711 | 11/1979 | Kamp | 242/35.5 A |
| 4,226,567 | 10/1980 | Van Orsdale, Jr. | 242/35.5 A X |
| 4,591,106 | 5/1986 | Gay | 242/35.5 A X |
| 4,615,493 | 10/1986 | Teranishi et al. | 242/35.5 A |
| 4,635.866 | 1/1987 | Kamp et al. | 242/36 |
| 4,736,898 | 4/1988 | Raasch et al. | 242/35.5 A X |

FOREIGN PATENT DOCUMENTS

| | | | |
|---|---|---|---|
| 0110275 | 6/1984 | European Pat. Off. | 242/35.5 A |
| 2133172 | 1/1972 | Fed. Rep. of Germany . | |
| 7436034 | 2/1975 | Fed. Rep. of Germany . | |
| 2324411 | 11/1976 | Fed. Rep. of Germany . | |
| 2446739 | 9/1983 | Fed. Rep. of Germany . | |
| 3511735 | 10/1986 | Fed. Rep. of Germany . | |
| 597082 | 3/1978 | Switzerland . | |
| 2001362 | 1/1979 | United Kingdom . | |

*Primary Examiner*—Stanley N. Gilreath

*Attorney, Agent, or Firm*—Shefte, Pinckney & Sawyer

[57] ABSTRACT

A package carrier member is positioned under a wound package by being pivoted at the end of a support arm that in turn is pivoted at the end of an arm of a package moving mechanism that includes a translational motion gear set so that upon rotation of the positioning arm the gear set will maintain the package in translational motion to a position closely above a package handling assembly at which the positioning mechanism pivots the carrier member to withdraw it from underneath the package. During this withdrawal a stop member is positioned against the package on the side opposite the direction of carrier member withdrawal to maintain the package in position against twisting, tilting or rotating as it is being released onto the package handling assembly. A package diameter sensing mechanism in the form of a roller on the end of an arm senses the diameter of the wound package in terms of the degree of pivoting of the arm, which information is applied through a comparator to control the moving means to position the carrier member closely under the package when the package has been raised for positioning of the carrier member thereunder.

23 Claims, 3 Drawing Sheets

METHOD AND APPARATUS FOR TRANSFERRING PACKAGES FROM WINDING STATIONS OF A TEXTILE WINDING MACHINE

This is a continuation of co-pending application Ser. No. 241,060, filed Sept. 6, 1988, now abandoned.

BACKGROUND OF THE INVENTION

The present invention relates to a method and an apparatus for transferring packages from winding stations of a textile winding machine to a package handling assembly.

In textile machines such as automatic winders, a movable, automatic service unit for automatic package removal removes wound packages and places them on a handling assembly such as a conveyor or a temporary storage device. In such operations, the packages are, typically, rolled or pushed along a steep surface from the winding station onto the handling assembly. In this regard, it is difficult to design the contours of the removal system such that the packages of the desired diameter and preferred conicity reliably reach the handling assembly in the proper orientation. It is especially problematic in the case of packages having a significantly conical shape. Also during the transfer operation there is a risk of damage to the yarn, especially at the tips of the packages. Further, because of the rolling and pushing of the packages, defective yarns occasionally occur to the detriment of further processing.

SUMMARY OF THE INVENTION

The present invention solves the above-described problems by providing a method and apparatus by which the packages are handled with minimal damage to the yarn and in which the occurrence of defective yarn is minimized while insuring the transfer of packages quickly and efficiently. The present invention also provides a method and apparatus for transferring packages which, in view of the manner, arrangement and position of the package transferring apparatus utilizes minimal space as compared with the prior art.

Further, the present invention provides for optimal package transfer without appreciable rolling or tripping of the packages as they are transferred to the package handling assembly and deposited thereon from a minimal height. Accordingly, the yarn is neither tangled nor torn.

Briefly described, the method for transferring packages from winding stations of a textile winding machine to a package handling assembly of the present invention includes positioning a package carrier member at a winding station in a position closely under the package, releasing the package onto the package carrier member, translationally moving the package carrier with the package supported thereon to a release position closely above the package handling assembly, and withdrawing the package carrier laterally from under the package to release the package onto the package handling assembly. This positioning, releasing, translational movement and withdrawing provides careful handling of the packages without undesirable damaging of the package and yarn that can result if the package rolls or otherwise moves in contact with other elements during the transfer. To further assure careful handling with minimal lateral and rotational movement of the package as the carrier member is withdrawn and the package released onto the package handling assembly, a stop member may be applied to the package laterally opposite the direction of withdrawing of the package carrier member, and the carrier member is formed with an upper generally arcuate concave surface for supporting the package, with the withdrawing of the carrier member being in an arcuate path corresponding generally to the arcuity of the concave surface of the carrier member.

Preferably, the method includes raising the package at the winding station prior to positioning the package carrier member thereunder. In this raising, the axis of the package may be oriented in a predetermined orientation, particularly when handling conical packages. Also, the package carrier member may be adjusted to accommodate the conicity of conical packages.

In the preferred embodiment of the method of the present invention, the diameter of the package is sensed to determine the level to which the package carrier member is positioned under the package to obtain a predetermined spacing between the positioned carrier member and the package prior to release thereof.

The apparatus of the present invention provides means for performing the above-described method.

Preferably the sensing is performed by means that includes a pivoted arm with a package engaging roller and means for determining the rotational position of the arm when the roller is in engagement with the package.

Means for performing the translational moving of the package carrier member preferably includes a drive motor, a drive shaft driven by the motor and driving the moving means, and a rotation counter connected to the drive shaft for counting rotation thereof. Control means responsive to the sensing means and to the rotation counter controls the motor for rotation of the drive shaft to position the package carrier member at a predetermined position relative to the underside of the package. The moving means also preferably includes a pivoted operating arm to which the positioning means is pivoted for movement of the carrier member under the package and the moving means adjusts the rotational position of the operating arm to thereby adjust the position of the package carrier member.

In the preferred embodiment, the moving means includes a pivoted operating arm and means for pivoting the operating arm, with the positioning means including a support arm pivoted to the operating arm and having the package carrier member connected thereto for pivoting under the package and for pivoting to withdraw from under the package. More specifically, the moving means may include a gear set mounted on the operating arm with the gear set having a drive gear at the pivot axis of the operating arm, a driven gear attached for rotation of the operating arm and fixed to the support arm at the pivot axis thereof and an intermediate gear meshing with both the drive gear and the driven gear so that upon rotation of the gear set with the operating arm the intermediate gear orbits on said drive gear and causes reverse rotation of the rotatable gear sufficient to maintain the support arm in a translational motion. Translational motion is accomplished by a 1:1 drive ratio of the drive gear and driven gear. In addition, the positioning means includes means for rotating the drive gear to cause rotation of the driven gear and thereby rotation of the support arm for positioning and withdrawal rotation of the package carrier member.

In the preferred embodiment, all of the components of the positioning means, releasing means, translationally moving means, stop member, package raising means and sensing means are mounted on a traveling service unit that is movable along the winding machine and positionable at individual winding stations to provide for automatic package transferring.

In an alternative construction, the package carrier member includes a plurality of rods for support of a package thereon rather than the aforementioned concave surface.

Further features and advantages of the present invention will be apparent from the accompanying drawings and the following detailed description of the preferred embodiments.

DETAILED DESCRIPTION OF THE PREFERRED EMBODIMENTS

Figure 1:
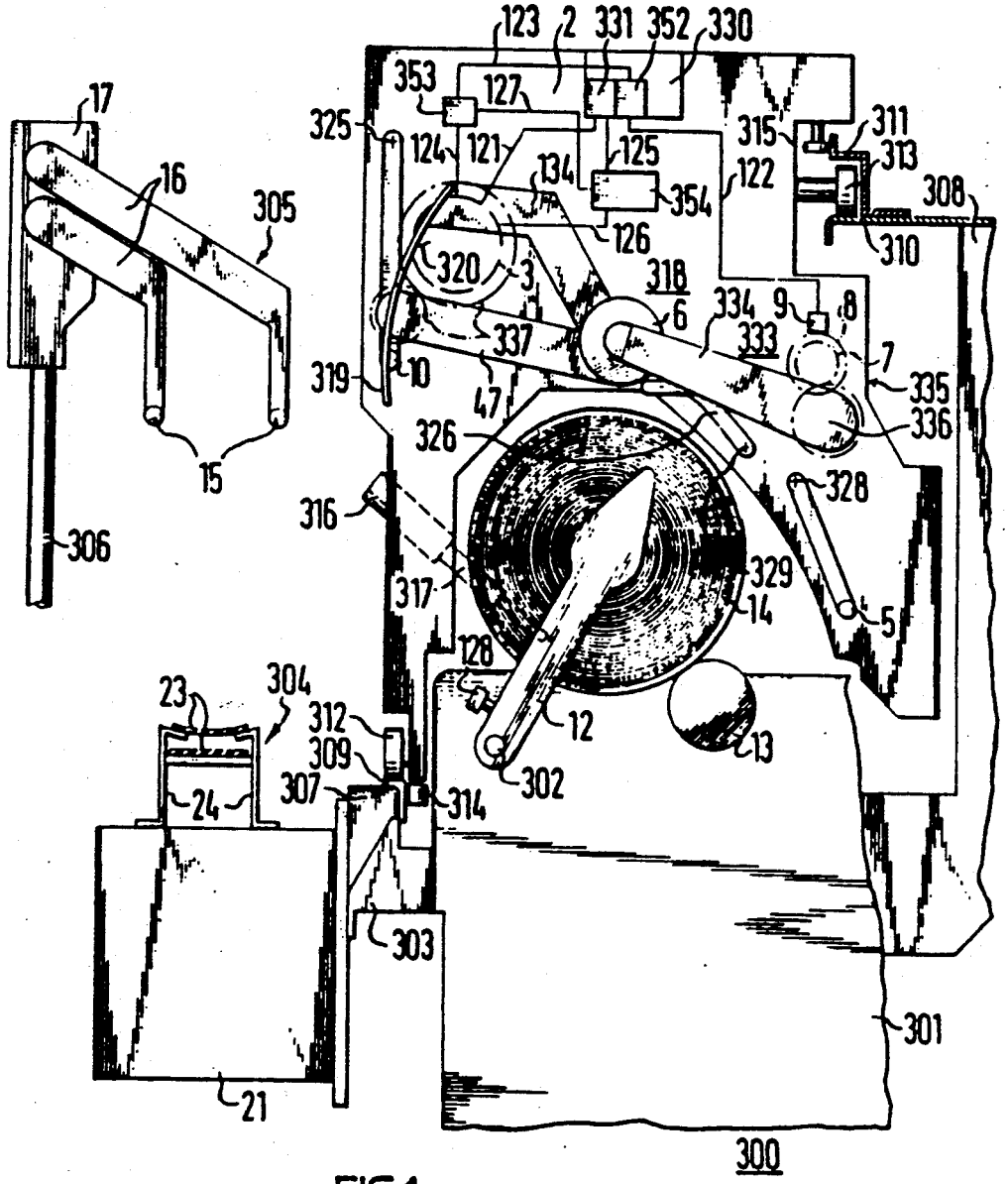
FIG. 1 is a side elevational view of a portion of an automatic winder with an automatic package doffing mechanism incorporating the transfer mechanism of the preferred embodiment of the present invention.

Referring to FIGS. 1-6, an automatic textile winding machine 300 is illustrated having a series of winding stations 301, only the first of which is illustrated and described herein, the others being of identical construction. The winding station 301 includes a winding drum 13 in frictional driving engagement with a package 14 being wound. A package spindle 12 supports the package 14 and is pivoted about a pivot 302.

The winding stations 301 are connected to a package handling assembly 21 through a connecting frame 303. The assembly 21 includes a lower package conveyor apparatus 304 and an upper package receiving apparatus 305 supported on posts 306 above the conveyor apparatus 304 and extending parallel to the machine 300 and to the lower conveyor apparatus 304.

The lower conveyor receiving apparatus 304 includes a transport belt 23 supported on brackets 24 mounted on the assembly 21.

The upper package receiving apparatus 305 includes two horizontally extending, parallel rods 15 projecting from arms 16 that are coupled to a housing 17 supported on the posts 306. Posts 306, housings 17 and arms 16 are located at the end winding stations of the machine 300 and at selected intermediate stations such as for each group of ten winding stations 301.

A rail 309 is supported from the assembly 21 by supports 307. Additional supports 308 on the machine support additional rails 310 and 311. A service unit 2 is movable along the length of automatic winding machine 300 on the rails 309, 310 and 311. In the preferred embodiment, the service unit 2 is an automatic package doffer which operates to doff wound packages 14 and replace them with empty winding cores. Since the present invention is concerned only with the removal of packages and not with the placement of empty cores, the structure of the service unit 2 for accomplishing the placement of empty cores is neither described nor illustrated herein.

Service unit 2 is supported on rails 309 and 310 by rail wheels 312 and 313, respectively, and is guided along these rails by guide wheels 314 and 315. At least one of the rail wheels 312 and 313 is driven by a controllable motor of known construction. Service unit 2 can be automatically moved to a desired winding station and positioned there in order to doff a finished package, insert an empty core and also to perform certain other types of work such as cleaning of the machine components.

Typically, service units, such as service unit 2, are provided with one or several control mechanisms that control their sequential operations. In the preferred embodiment, the service unit 2 also includes such control mechanisms, those of which that pertain to the present invention will be described.

The service unit 2 includes a pneumatic piston 316 which is shown only in FIG. 1. A telescoping arm 317 of the pneumatic piston 316 is connected at its outer end to the spindle 12. The arm 317 can be telescoped out to swing the arm of the spindle 12 to the side and thereby open the spindle to release a package or for receipt of a winding core. When not activated, the arm 317 is retracted back into the pneumatic piston 16.

Figure 7:
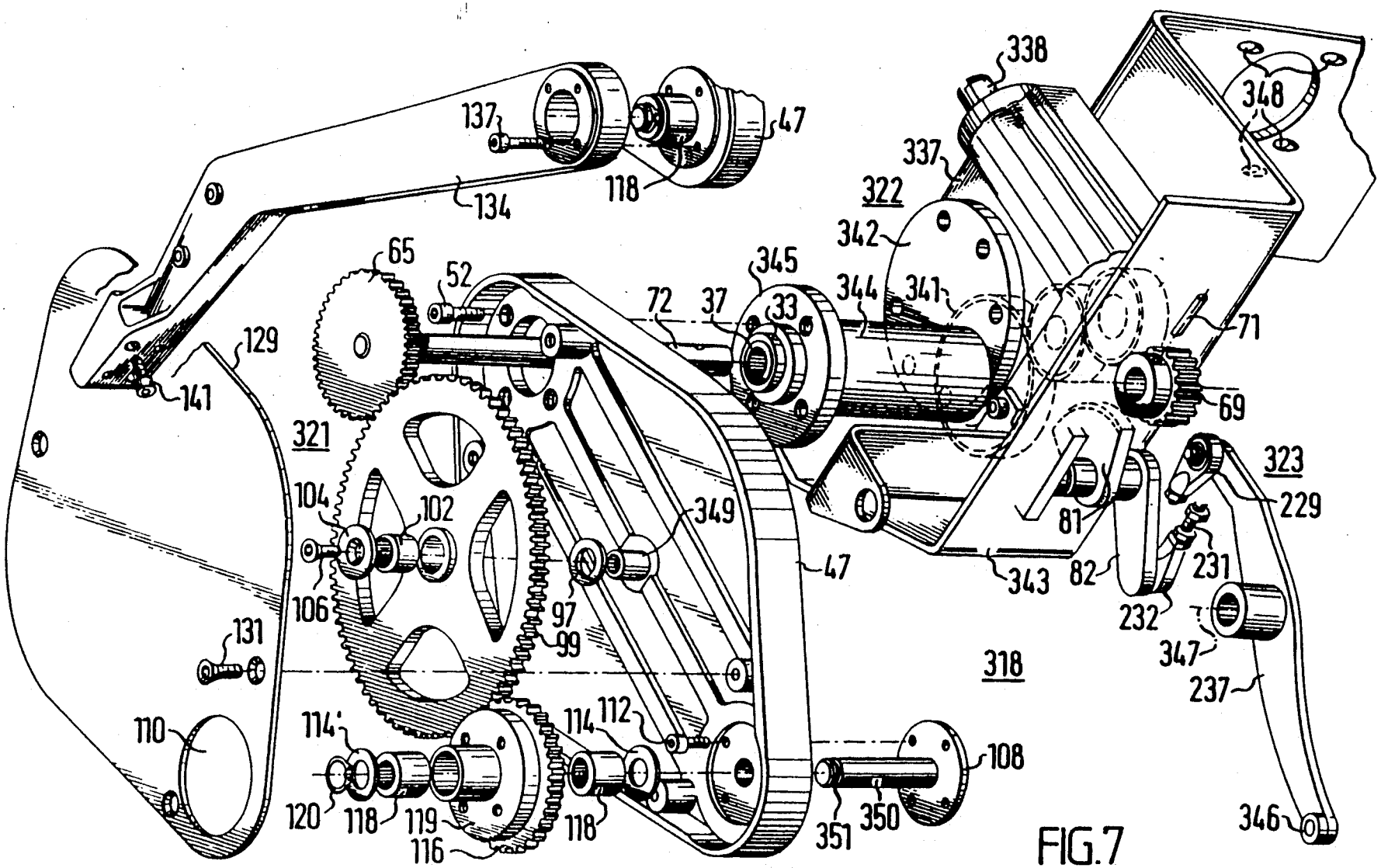
FIG. 7 is an enlarged exploded perspective view of the operating mechanism for the positioning means and moving means of the preferred embodiment of the present invention.

To remove packages 14 from the spindles 12, the service unit 2 includes the means 318 for transferring packages according to the preferred embodiment of the present invention, the operating mechanism of which is illustrated in detail in FIG. 7. This means 318 includes a package carrier member 319 which moves from a retracted rest position (shown in FIG. 1) to a package receiving position (shown in FIG. 2) in which a wound package 14 is released for support thereon. The carrier member 319 includes a concave upper surface 320 positioned at the end of a support arm 134. Means for imparting translational motion to the support arm 134 and means for rotating the support arm for positioning of the package carrier member 319 are provided; using a mechanism 321 (FIG. 7) for providing translational motion, a mechanism 322 (FIG. 7) for rotating the support arm and a mechanism 323 (FIG. 7) for positioning the carrier member 319. The positioning mechanism 323 operates to rotate the support arm 134 to move the package carrier member 319 along an arcuate path 324 (shown in FIG. 4) for withdrawal from under the package so that the package 14, which is positioned over the package handling assembly 304 or 305, may be released thereonto.

Figure 2:
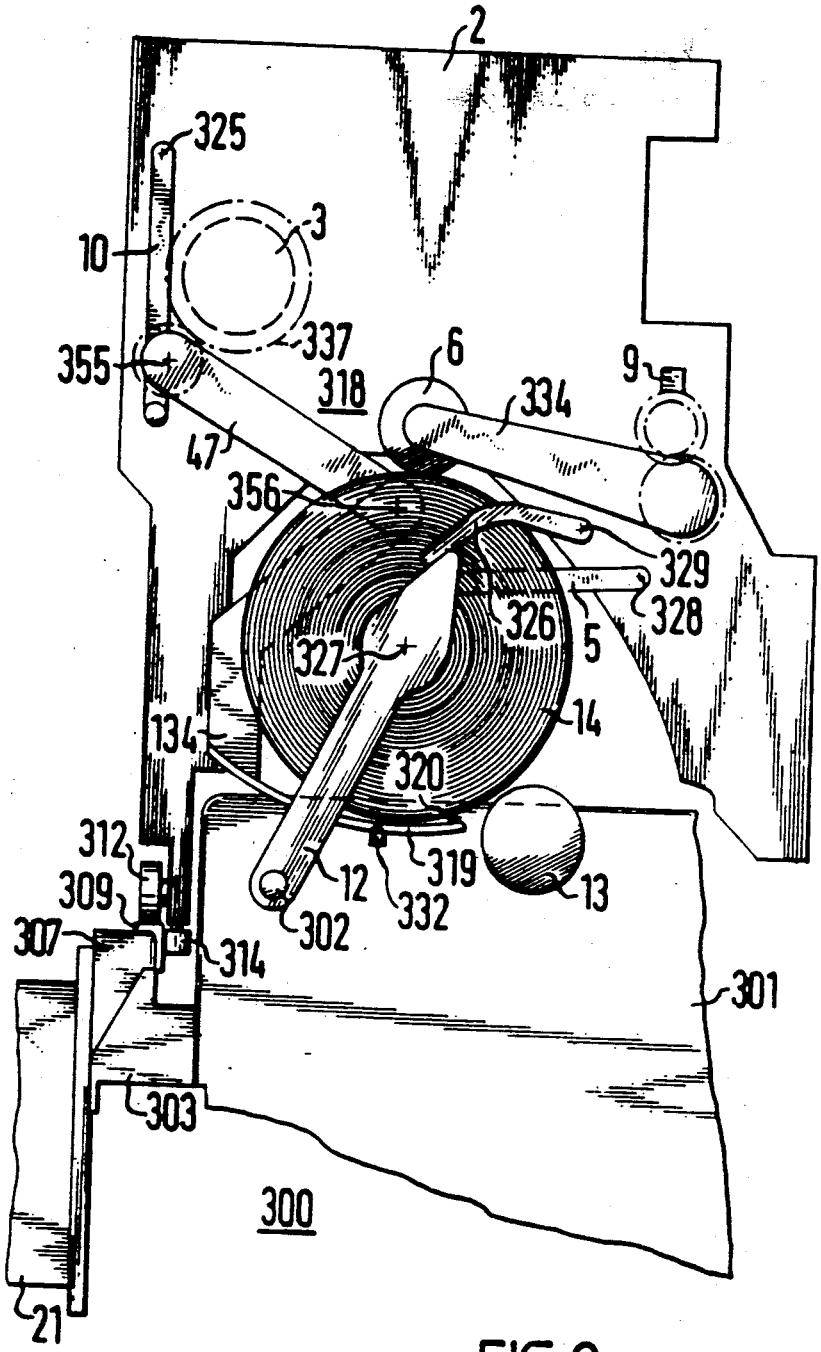
FIG. 2 is an enlargement of a portion of FIG. 1, showing the position of the components at the beginning of the transfer process.
Figure 3:
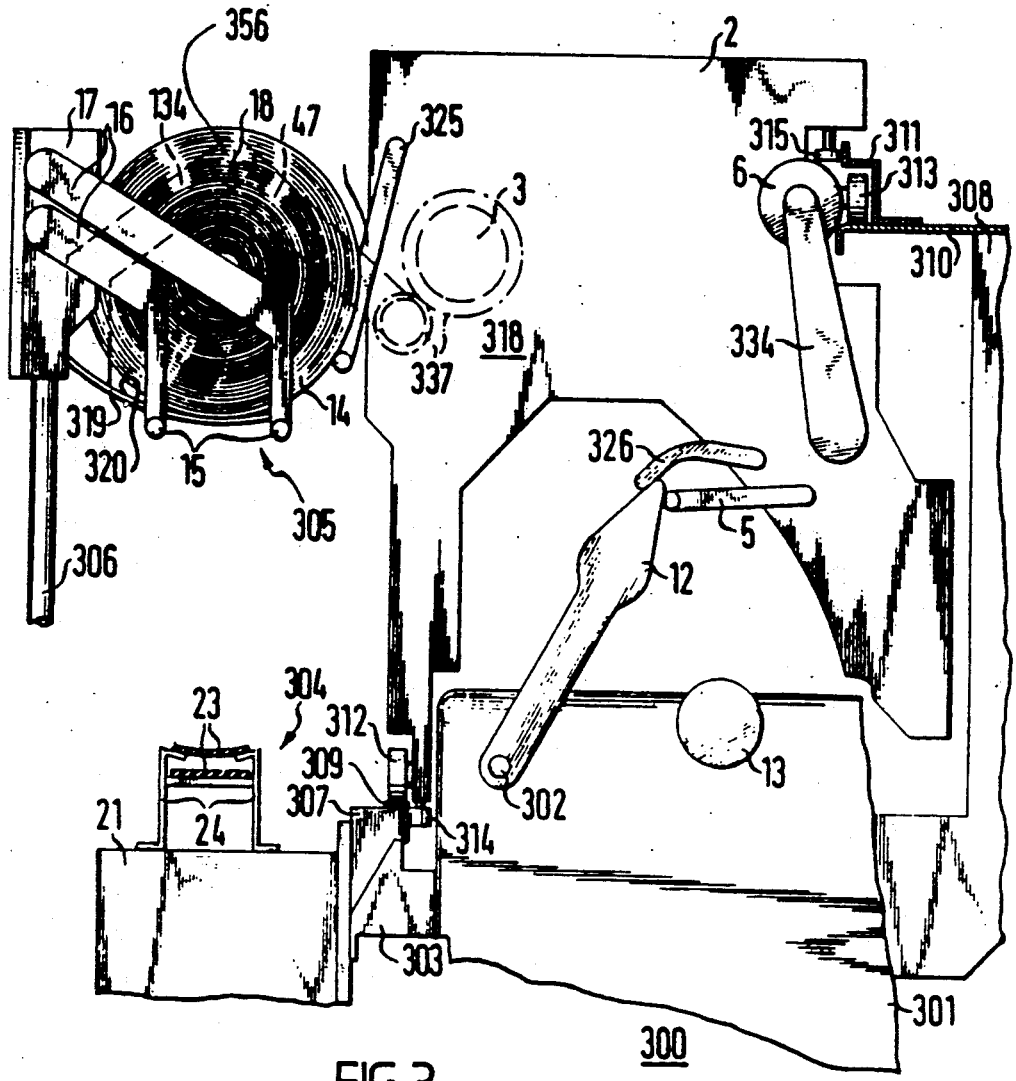
FIG. 3 is a view similar to FIG. 1, showing the position of the components immediately prior to release of the package onto the package handling assembly.
Figure 4:
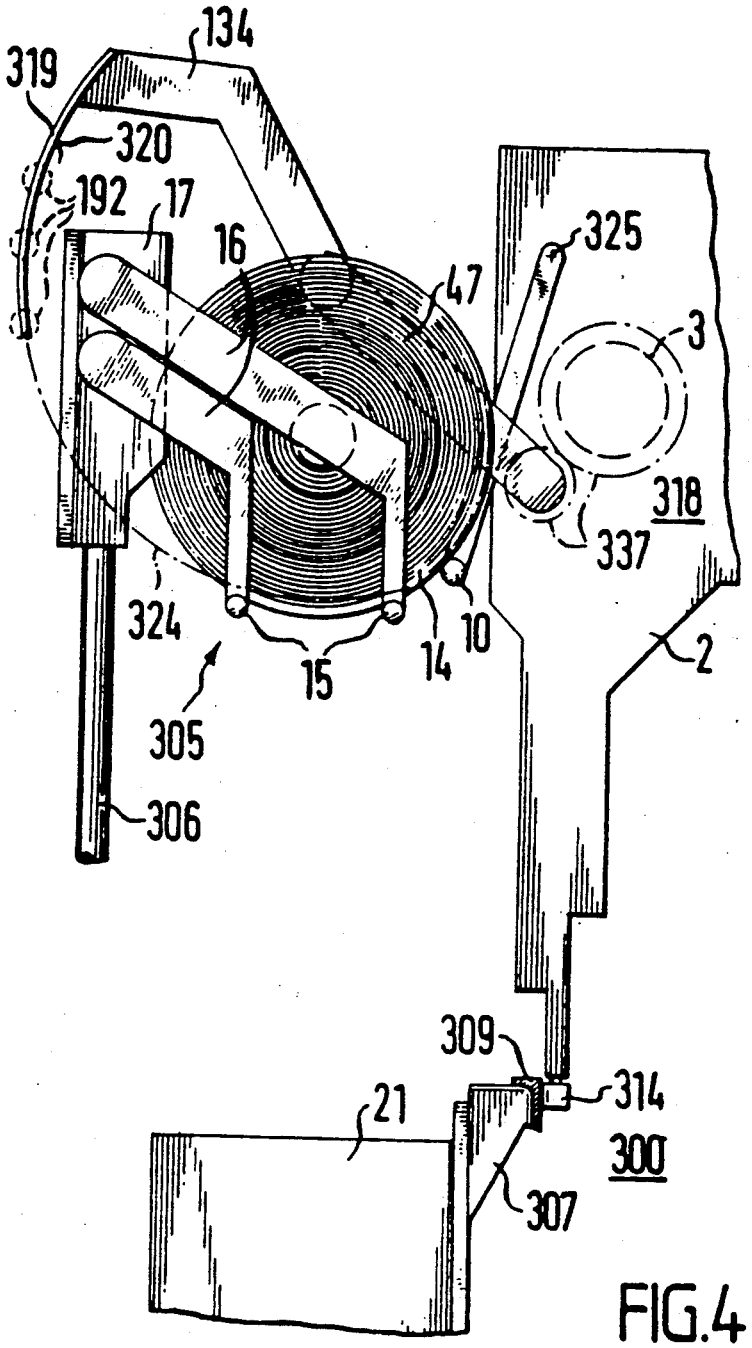
FIG. 4 is an enlargement of a portion of FIG. 1, showing the package released onto the package handling assembly with the package carrier member withdrawn.
Figure 5:
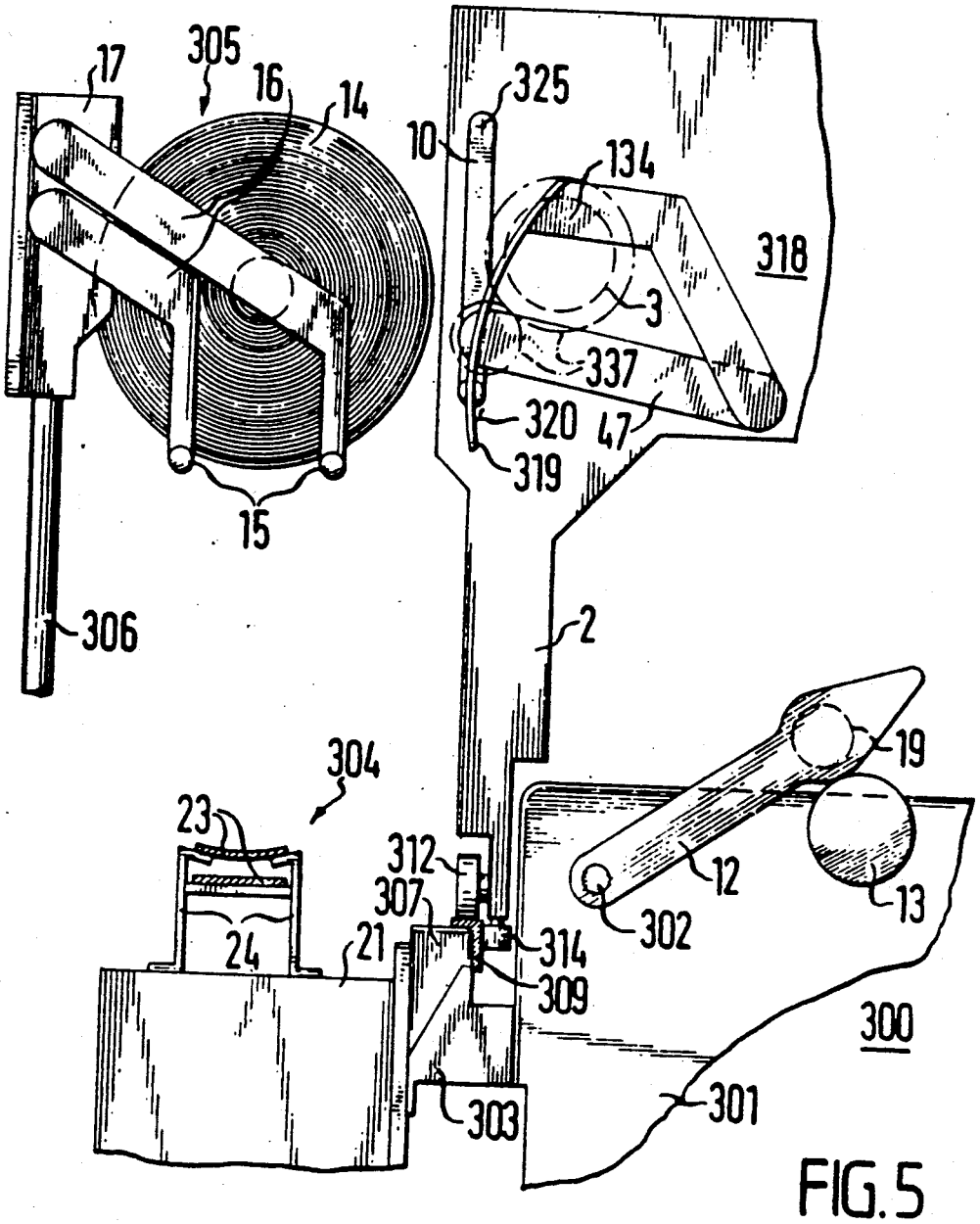
FIG. 5 is a view similar to FIG. 1, showing the package positioned on the package handling assembly and the components of the package transferring means returned to their inactive position.
Figure 6:
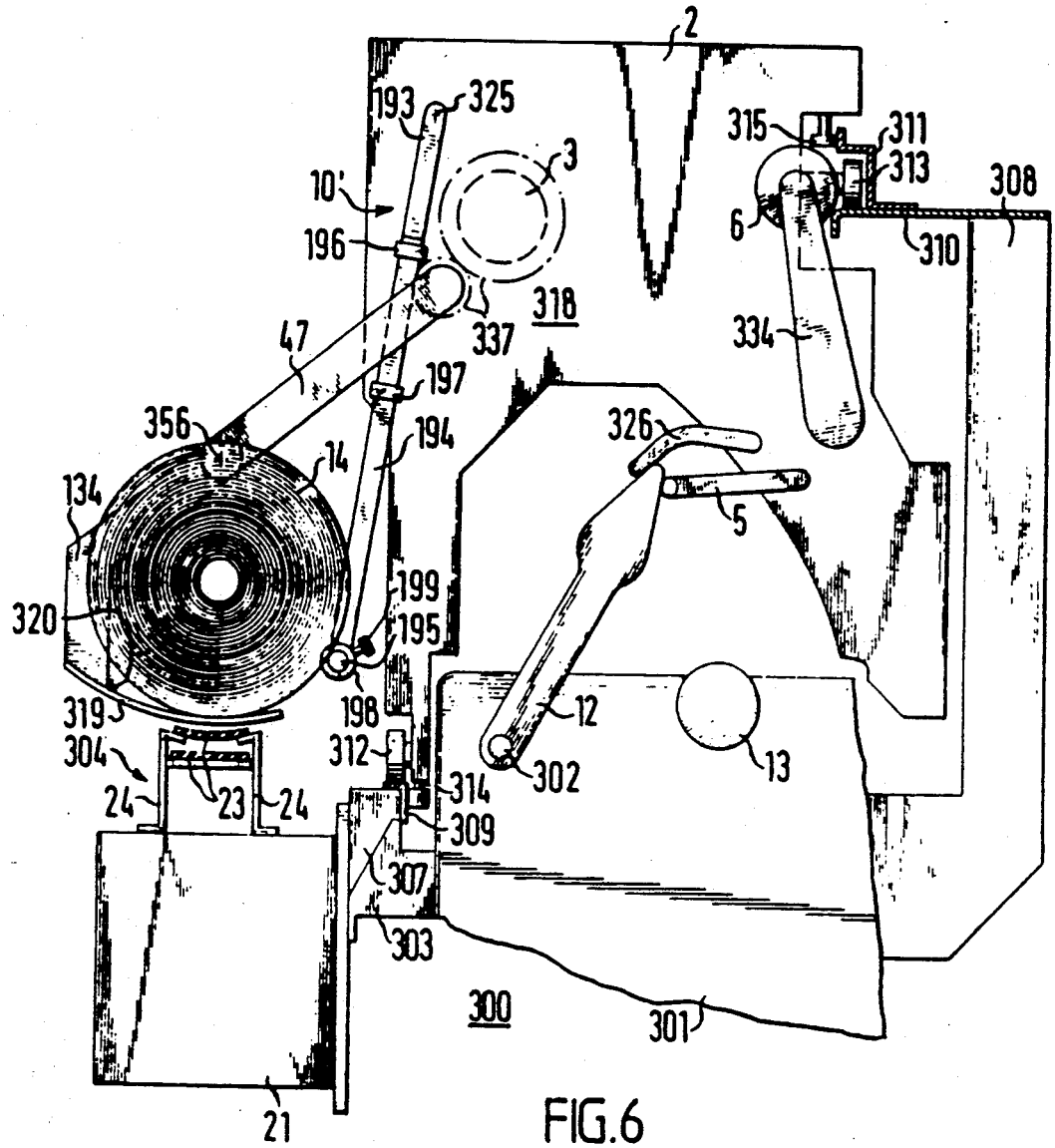
FIG. 6 is a view similar to FIG. 3 showing the package being positioned directly onto a conveyor belt of a package handling assembly.

The service unit 2 also includes a stop member 10 which is movable from a retracted position to a position in engagement with the package opposite the direction of withdrawing of the carrier member to resist lateral and rotational movement of the package as the carrier member is withdrawn and the package released onto the package handling assembly 304, 305. The retracted position of the stop member 10 is shown in FIGS. 1, 2 and 5 while the support position in which the stop member 10 engages the side of the package is shown in FIGS. 3, 4 and 6. The stop member 10 includes a cross bar supported on an arm, with the arm rotatably connected to the service unit 2 at a pivot 325 and controlled by a conventional mechanism such as a cam mechanism. The service unit 2 additionally includes a package raising means 5 which cooperates with a spindle tilting mechanism 326 to move the spindle 12 to a position in which the package 14 is in a desired position with a predetermined orientation of its longitudinal axis. The desired position of each package is the position in which it is spaced from the driving drum 13 and the package axis 327 is horizontal.

Another embodiment of the stop member of the service unit 2 is illustrated in FIG. 6 and designated as 10'. The stop member 10' is pivotally connected by a pivot 325 to the service unit 2 and includes an axially extendable portion.

As shown in FIG. 2, the spindle tilting mechanism 326 cooperates with the forward carry arm of the spindle 12 while the raising mechanism 5 cooperates with the underside of the spindle arm.

The raising mechanism 5 is rotatably supported on the service unit 2 at a pivot 328 and is upwardly movable from its retracted inactive position shown in FIG. 1 to engage the arm of the spindle 12. Movement of the raising mechanism 5 can be controlled by an appropriate control mechanism, such as the control mechanism that controls the movement of the stop member 10.

The orientation of the carrier member 319 can be varied with respect to the variables of the cone diameter and cone conicity. To adjust for these variables, the carry element 319 has a positioning selector 330 which sets the member 319 to the appropriate position to engage the package 14. The positioning selector 330 has a self-actuating spacing controller 331 which controls the position of the carrier member 319 so that it is set at a predetermined spacing, within a predetermined millimeter or centimeter range, from the outer surface of the package 14. The spacing controller 331 has package sensing means 333 that includes an angle indicator 335 which indicates the rotational position of a pivoted arm 334 carrying a package engaging roller 6. The angle through which arm 334 rotates to make contact between the roller 6 and the outer surface of the package 14 provides an indication of the diameter of the package.

The pivoted arm 334 is rotatably mounted on the service unit 2 at a pivot point 336. The rotational movement of the arm 334 is transmitted to an impulse disc 8 coaxial with a gear mechanism 7 rotated by a mating gear fixedly mounted to the arm 334. A sensor 9 monitors the impulse disc 8 so as to provide a signal corresponding to the magnitude of pivoting of the arm 334. One arrangement by which the sensor 9 can monitor the impulse disc 8 is an arrangement in which the disc 8 has magnets spaced around its circumference to induce an electrical impulse in a winding in the sensor 9.

The roller 6 positioned at the free end of the pivot arm 334 rotatably engages the package 14 during selected phases of the operating of the winding machine. The sensor 9 measures the pivot angle of the arm 334 when the roller 6 is moved out of its retracted position (shown in FIG. 3) and lowered to engage the package 14. The greater the diameter of the package, the fewer the impulses that will be measured by the sensor 9.

The mechanism 321 for providing translational motion ensures that the carrier member 319 and the package 14 carried thereon are not tipped, twisted, rotated or tilted irrespective of the movement of the support arm 134. As seen in FIG. 7 the translational motion mechanism includes a gear assembly having a drive gear 65, an intermediate gear 99 and a driven gear 116. These gears are mounted on a pivoted operating arm 47 in the form of a housing, which is connected to the output shaft of a gear motor 322. As seen in FIG. 7, the gear motor 322 has a gear box 337 and a drive shaft 338, with the gear box 337 being mounted on a frame 343 and having a cover plate 342. The output of the gear box 337 is transmitted by a gear 341 to a main shaft 344 connected thereto. A main shaft collar 33 and a flange 345 are secured to the main shaft 344, and the operating arm or housing 47 is secured to the flange 345 by bolts 52.

As seen in FIG. 7, the drive gear 65 is connected through the gear box 337 to the support arm rotating mechanism 323, which cooperates with a control mechanism having a cam (not shown) in driving contact with a follower 346 on one end of a lever 237 that is movably mounted on the service unit 2 for pivoting about an axis 347. The other end of the lever 237 is connected to an end 229 of an adjustable rod 231 having its other end 232 connected to a crank arm 82 that is rotatably mounted on the gear box frame 343 and has mounted thereon a gear segment 81. The gear segment 81 meshes with a gear 69 that is fixed by a key pin 71 on one end of a shaft 72 that is rotatably mounted within an axial bore 37 in the main shaft 344 and is connected at its other end to the drive gear 65. To adjust the plane of pivoting of the housing 47, the gear frame 343 is adjustably connected to the housing of the service unit 2. For this purpose, the gear frame 343 is provided with longitudinal slots 348 which allow limited adjustment of the mounting on the service unit frame.

Approximately in the middle of the housing 47 is a threaded stud 349 having a washer 97 supported thereon. The intermediate gear 99 is mounted on a bearing 102 which is mounted on the stud 349. Thus, the intermediate gear 99 is thereby supported on the stud 349 and spaced from the housing 47 by the washer 97. A screw 106 is threadably received in the stud 349 and a washer 104 on the opposite side of the intermediate gear 99 is positioned on screw 106. The drive gear 65 and the driven gear 116 each have the same number of gear teeth so that the translation ratio between the gear is 1:1.

At the end of housing 47 opposite the end at which the shaft 72 enters is an opening through which a stud shaft 350 projects. One end of the stud shaft 350 is connected to a flange 108 having threaded holes for receiving screws 112 which extend through aligned holes in the housing 47 to secure the flange 108 to the housing 47. The driven gear 116 is rotatably secured on the stud shaft 350 on a bearing 118 which allows the gear to rotate about the stud shaft 350. A washer 114 spaces the bearing 118 from the inside of housing 47 and a second washer 114' spaces the bearing 118 from the other side of housing 47, with a lock washer 120 engaging an annular groove 351 in the stud shaft 350 to secure the gear 116 to stud shaft 350.

The driven gear 116 has a flange 119 which is connected to the support arm 134 by screws 137. The thickness of the flange 119 is such that the flange projects through an opening 110 in a side cover 129 of the housing 47 with the side cover 129 being secured to the housing 47 by screws 131.

Figure 8:
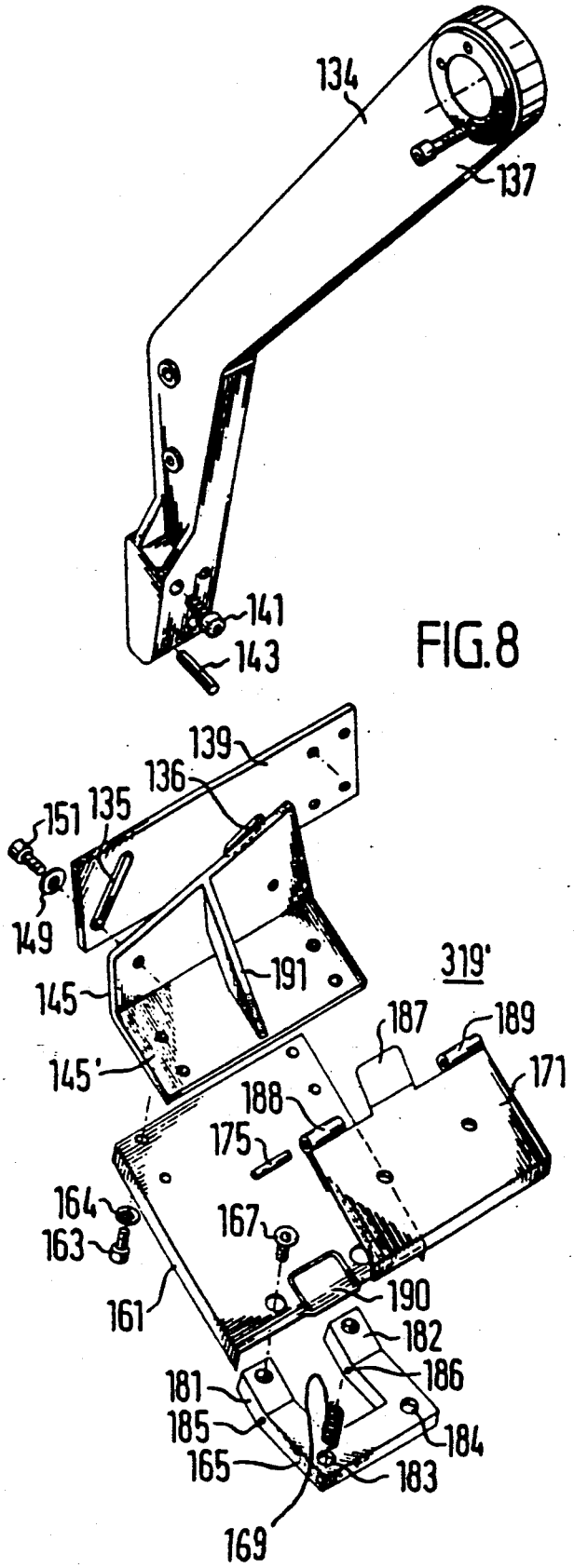
FIG. 8 is an exploded perspective view of a preferred embodiment of the package carrier member included in the package transferring means of the present invention.

As shown in FIGS. 1-6, carrier member 319 has an upper concave surface 320 for supporting a package 14. The carrier member can be formed from a section of pipe, or a correspondingly bent sheet, or two or more components secured together at an angle to one another. The latter is illustrated in FIG. 8, in which the carrier member 319' includes a plate 139 secured to the free end of the support arm 134 by two screws 141 and two slotted pins 143 (only one screw 141 and one pin 143 being shown). The plate 139 has two non-parallel slots 135 and 136 which receive screws 151 to thereby connect an angle plate 145 to the plate 139. Washers 149 are mounted on the screws 151. The screws 151 can be moved along the slots 135 and 136 to vary the position of the angle plate 145 with respect to the plate 139 so that the foot portion 145' of the angle plate 145 can be adjusted over a range of positions. The angle plate 145 forms one component of the carrier member 319'. Another component is a plate 161 that includes a stirrup 165 having upwardly bent feet 181 and 182 that are secured by screws 167 to the plate 161. The stirrup 165 includes recesses 183 and 184 that receive coil springs 169. The feet 181 and 182 of the stirrup 165 have aligned hinge pin receiving holes 185 and 186, respectively. A second plate 171 above stirrup 165 includes an upwardly bent nose 187 and two hinges 188 and 189. The nose 187 seats in a recess 190 in the middle of the end of first plate 161. Hinge pins 175 are inserted through hinges 188 and 189 and into the holes 185 and 186 whereby the second plate 171 is hingedly connected to the stirrup 165. The hinge arrangement and the springs provide the second plate 171 with spring-cushioned movement through a limited range. The plate 161 is secured to the foot portion 145' of the angle plate 145 by a plurality of bolts 163, the bolts having associated washers 164 (only one bolt 163 and one washer 164 being shown).

When small packages are handled by the carrier member 319', the packages lie on plates 161 and 171 while large packages are supported by a cross piece 191 of the angle plate 145, which cross piece 191 contacts packages of relatively large diameter along their side surfaces. However, a third embodiment of the carrier member 319 can be used to support all packages 14 along their bottom surfaces. For example, as seen in FIG. 4, the carrier member 319 can include three rollers 192 each of greater length than the package 14, with the rollers 192 secured to rods in a lattice-like arrangement. In a simpler embodiment, rollers 192 can be replaced by simple rounded rods.

One advantage of the present invention is that the apparatus can operate with package handling assemblies of various heights. To adjust for the various heights, the housing 47 can be moved to the appropriate angular position so that the transfer of the package to the handling assembly can be performed at various predetermined locations. Also, the vertical arm of the stop member 10 or 10', respectively, is adjustable to a predetermined length. Specifically, to eliminate the need to exchange stop members in order to adjust for the height of the package handling assembly, the stop member 10 is formed with two lengthening rods 193 and 194 and a cross rod 195. The lengthening rod 194 is movably secured within the lengthening rod 193 and is extendable therefrom. Two tightening rings 196 and 197 lock the lengthening rod 194 with respect to the rod 193 when the rod 194 has been extended to the appropriate position. The free end of the rod 194 has a bore 198 which receives the cross rod 195, which is rotatable within the bore 198 through a wide angular range. A stop screw 199 threaded into the bore 198 fixes the cross rod 195 in a desired position. This adjustability of the cross rod 195 allows the operator to adjust the carrier member 319 to packages of various conicity.

As shown in FIG. 1, an electronic control mechanism 330 is provided on the service unit 2 to control the movement of the carrier member 319 to the appropriate package receiving position. The electronic control mechanism 330 comprises an electronic comparator 352 which is operably connected to a spacing controller 331 that is operably connected to the rotation mechanism 322 (FIG. 7) by a connecting lead 121 and operates a drive motor 3 in accordance with signals received from the comparator 352. The comparator 352 is connected by a connecting lead 122 to the sensor 9 of the sensing mechanism 335 and is connected by a lead 123 to the rotation counter 353 of the drive motor 3, with the rotation counter 353 being connected through a lead 124 to the drive motor 3.

When the cam mechanism of the package transferring apparatus 318 is activated, the arm 334 is rotated downward until the roller 6 engages the surface of the package 14. The sensor 9 counts the impulses received from the impulse disc 8 during the downward rotation of the arm 334 and transmits its count to the comparator 352. The comparator 352 then activates the spacing controller 331, which in turn signals drive motor 3 through lead 121 to activate the rotation mechanism 322, which rotates the housing 47 from its retracted, inactive position (FIG. 1) to a package receiving position (FIG. 2). During the operation of the drive motor 3, the rotation counter 353 counts the rotation of the drive motor output shaft and transmits the result to comparator 352, which compares the count from the rotation counter 353 with the count from the sensor 9 and, when the two counts correspond, stops the spacing controller 331. If the package diameter is large, the sensor 9 will count only a few impulses. In that circumstance, the drive motor 3 stops after a corresponding number of rotations, which need not necessarily correspond exactly with the impulse count. In the preferred embodiment, the carrier member 319, as shown in FIG. 2, is moved to approximately one centimeter under the package 14.

If the package 14 is of a small diameter, the arm 334 will pivot downward to a relatively large degree and the sensor 9 therefore counts more impulses. However, after being raised to the position shown in FIG. 2, the underside of a smaller package would not be as low as the underside of the illustrated large package 14. This means that the more impulses sensor 9 counts, the fewer the rotations of the output shaft of drive motor 3 should be allowed. The number of rotations for each individual series of package sizes can be empirically determined and stored in the comparator 352.

The spacing controller 331 is operatively connected through a connecting lead 125 with a control device 354, which is connected through a connecting lead 126 with the drive motor 3. Once the spacing controller 331 has set the carrier member 319 to the appropriate spacing, the control device 354 takes over further control of the drive motor 3 so that the housing 47 can be rotated between the package receiving position (FIG. 2) and the package releasing position (FIG. 3 or 6). The control of the drive motor 3 through the control device 354 is related to the number of rotations counted by the rotation counter 353 and transmitted through the lead 127 to the control device 354. The rotation count of the drive motor 3 varies according to the package size measured by the sensor 9 and this relationship can be empirically determined. The control device 354 also controls the return movement of housing 47 to the beginning position shown in FIG. 1.

The apparatus of the present invention operates as follows. Initially, the size of the package being wound is sensed by the position of the spindle 12 by a microchip 128 which senses the angular position of the spindle 12 and sends a stop signal to the drive of the winding drum 13 and a call signal to the service unit 2 to immediately respond or, in known fashion, to stop at the winding station 301 in the course of its travel. The roller 6 is then lowered to engage the surface of the package, during which the sensor 9 counts the impulses and transmits the count through the lead 122 to the control device 330. Then, the spindle raising mechanism 5 and spindle tilt apparatus 326 are activated to move the spindle 12 with the package 14 thereon to the predetermined axial position 327. The rotation mechanism 322, the translational motion mechanism 321 and the control device 330 then manipulate the package carrier 319 in response to the sensed package diameter such that the carrier member 319 is positioned under the package 14 at a distance of approximately one centimeter from the surface of the package.

If desired, further processing of the package 14 can now proceed with the package raised from the winding drum 13. For example, the yarn end can be wound on the core end to form a yarn reserve, in which event the friction roller 6 operates for a certain period. For this further processing, the roller 6 may be driven by its own drive motor (not shown). When the further handling is finished, the arm 334 pivots the roller 6 to the retracted position shown in FIG. 3. Then, the spindle opener 316, controlled by a sequence control device, opens the spindle 12 whereby the package 14 is released from the spindle 12 onto the carrier member 319. Then, the rotation mechanism 332 pivots the housing 47 in a counterclockwise direction sequentially upwardly, laterally and downwardly to the release position shown in FIG. 3 and immediately stops due to the action of a self-stopping device such as, for example, a combination of worm gears within the rotation mechanism 322. At the same time, the translational motion mechanism 321 (FIG. 7) insures that package 14 neither tilts nor rolls during transport.

As shown in FIG. 3, the package 14 can be delivered to the upper package handling assembly 305 which means that the carrier member 319 is positioned directly over the rods 15 of this assembly. Then, the sequence control device controls the stop member 10 so that the cross rod 195 of the stop member lies against the surface of the package 14, as shown in FIG. 3. At the same time or subsequent thereto, the retraction mechanism 323 is operated to retract the support arm 134 as shown in FIG. 7. The support arm 134, which carries the carrier member 319, is pivoted in a clockwise direction so that the carrier member 319 is retracted along an arcuate path corresponding generally to the curvature of the surface 320 of the carrier member 319 with the stop member 10 being located on the side of the package opposite the direction of carrier member retraction. During this movement, the support arm 134 pivots around the pivot point 18 shown in FIG. 3. Following this movement, the support arm 134 and the carrier member 319 are in their position shown in FIG. 4 with the package thereby released onto the package handling assembly 305. During the movement, the carrier member 319 is upwardly pivoted along the arcuate path 324.

After the package 14 has been released onto the rods 15, the housing 47 is driven in a clockwise direction to return to its initial position as shown in FIG. 5. Also, the stop member 10 or 10', respectively, is retracted to its initial inactive position.

During the return of housing 47 and stop member 10 or 10', respectively, to their initial positions, the spindle 12 automatically receives a new empty winding core 19 from the service unit 2 so that production of another package at the winding station 301 can begin. In the event that the service unit 2 has no further function at the winding station 301, it receives a signal to move to another station.

As soon as packages have been transferred from all of the winding stations, the package handling apparatus 305 can be detached for transport of the packages or can be lowered to deposit the packages on conveyor 23 of the lower package handling assembly 304. If, for example, the completed packages are removed with the upper assembly 305, packages can be transferred directly to the conveyor belt 23 of the lower package handling assembly 304 as shown in FIG. 6. In this regard, the transferring means 318 need not be modified or changed except for the modifications that the housing 47 is pivoted through a longer arc and the stop member 10 is appropriately lengthened.

In the preferred embodiment, a cylindrical package 14 is illustrated. If conical packages are wound, it may be necessary to set the pivoting plane of the housing 47 with respect to the conicity of the package in addition to correspondingly adjusting the stop member 10 with respect to the diameter of the package, the conicity of the package and the height of the package handling assembly. This can be done, for example, through appropriate positioning of the gear assembly 343 along the longitudinal slots 348 (as seen in FIG. 7). Also, the carrier member 319' can be adjusted to the various conicity of the packages, for example, by adjustment along the slots 135 and 136 (FIG. 8).

As the package 14 moves downward about two to three centimeters when the package carrier member 319 is withdrawn, as seen in FIGS. 3 and 6, and it is released onto rods 15 or the conveyor 23, it is especially advantageous when relatively large packages are being handled to pivot the stop member 10 or 10', respectively, back a small amount at the same time as the carrier member 319 is withdrawn so that the longitudinal axis of the package remains oriented over the middle of the respective package handling assembly.

The spindle opening mechanism 316 can be provided at each individual winding station or it can operate spindles at a number of stations. In another embodiment, the package transfer means 318 can be provided with a package sensing mechanism 332 operatively connected to the space controller 331. As shown in FIG. 2, the sensing mechanism 332 is mounted on the carrier member 319. The sensing mechanism 332 can be a proximity sensor which, for example, can measure the spacing between the surface of the package and the carrier member 319 and can activate the drive motor 3 in a timely manner, if the required spacing has not yet been reached, and thereafter stop the drive motor 3 when the desired spacing has been reached. The movement of the carrier member 319 until the engagement of the drive motor 3 can proceed relatively rapidly. The installation of such a sensing mechanism would require correspondingly greater use of electrical connectors.

The apparatus of the present invention is adapted for use with various winding machines. In certain of these machines, for example, the package driving drum 13 continues to run after the desired yarn feeding is completed so that the packages continue to rotate and thereby occasionally wind the yarn end onto the package until the spindle raising mechanism 5 lifts the spindle from the rotating drum 13.

The lifting of the spindle 12 can be accomplished by a mechanism at the winding station 301 rather than on the service unit 2. For this reason, it is not always necessary that the service unit 2 be equipped with a spindle raising mechanism 5. However, such a mechanism is necessary if the apparatus of the present invention is to be used with existing machines.

In some circumstances, each individual winding station is equipped with a self-driven winding drum 13 so that the rotation of the drum ceases when the desired package fullness has been achieved. When used with machines of this type, the service unit 2 engages an already non-moving package which does not have to be raised unless, for example, the package requires a yarn reserve to be added. For such purpose, the service unit 2 is preferably provided with the spindle raising mechanism as well as the spindle tilting mechanism. It is to be noted that, in other circumstances, a spindle tilting mechanism can be provided at each individual winding station.

If the carrier member 319 is pivoted from the initial position shown in FIG. 1 to a position underneath the package 14 without any preparatory movement of the housing 47, the carrier member 319 would contact the package before it could be positioned thereunder. For this reason, it is necessary to pivot the housing 47 in a clockwise direction either before or at the same time as the carrier member 319 is pivoted. After the carrier member 319 has picked up the package 14, the housing 47 is pivoted in a clockwise direction around the pivot point 355 shown in FIG. 2.

The translational motion mechanism 321 can be positioned such that the support arm 134, during the period of movement of the housing 47, hangs freely from the pivot point 356, as shown in FIG. 2. The package 14, together with the carrier member 319 and the support arm 134, hang in constant balance underneath the pivot point 356. Such an arrangement is not advantageous, however, because it is impossible to avoid some free pivoting during the transfer operations. Such pivoting can cause the package 14 to fall from carrier member 319 as well as other undesirable consequences. For this reason, a controlled translational motion mechanism 321 of the type described above or equivalent is preferred, although more components may be required. Also, the coordination between the positioning mechanism 323 and the translational motion mechanism 321 works smoother with a controlled system.

As shown in FIGS. 1-6, the service unit 2 has a portal-type housing. This housing, however, does not in any way limit the mobility of the package transferring means 318 because numerous movable parts are on the front side of the housing. All the upwardly pivoting parts remain behind the movement plane of the package 14. The housing of the service unit 2 is for this reason preferably constructed as a portal-type housing so that it can travel through the winding stations 301. Typically, there is sufficiently large room to accommodate this.

Instead of measuring the diameter of packages 14 with the sensor 9, the diameter measurement can be accomplished in conventional ways, such as, for example, with electronic components.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A method for transferring packages from winding stations of a textile winding machine to a package handling assembly, comprising:

positioning a package carrier member at a winding station in a position closely under the package;

releasing said package into said package carrier member;

translationally moving said package carrier member, with said package supported thereon, to a release position closely above the package handling assembly; and withdrawing said package carrier member laterally from under said package to release said package onto the package handling assembly.

2. A method for transferring packages according to claim 1 and characterized further by applying a stop member to said package laterally opposite the direction of withdrawing of said package carrier member during said withdrawing to resist lateral and rotational movement of said package as the carrier member is withdrawn and the package is released onto the package handling assembly.

3. A method for transferring packages according to claim 1 or 2 in which the carrier member has an upper generally arcuate concave surface for supporting the package thereon, said method being characterized further in that in said withdrawing the carrier member is withdrawn in an arcuate path corresponding generally to the arcuity of the concave surface of the carrier member.

4. A method for transferring packages according to claim 1 and characterized further in that said moving said package comprises moving said package in an arcuate path sequentially upwardly, laterally and downwardly to said release position.

5. A method for transferring packages according to claim 1 and characterized further by raising the package at the winding station prior to said positioning of said package carrier member under the package.

6. A method for transferring packages according to claim 5 and characterized further in that in raising the package the axis of the package is oriented in a predetermined orientation.

7. A method for transferring packages according to claim 1 and characterized further by adjusting the package carrier member to accommodate the conicity of conical packages.

8. A method for transferring packages according to claim 1 or 5 and characterized further by sensing the diameter of the package and adjusting the positioning of the package carrier member under the package in relation to the sensed package diameter to obtain a predetermined spacing between the positioned carrier member and the raised package.

9. An apparatus for transferring packages from winding stations of a textile winding machine to a package handling assembly, comprising:

a package carrier member for supporting a package to be transferred thereon;

an operating arm having opposed ends, one of said opposed ends of said operating arm being pivotally connected by a first pivot to the textile winding machine for pivoting of said operating arm through a generally vertical first plane about a generally horizontal axis;

a support arm having opposed ends, one of said opposed ends of said support arm being pivotally connected by a second pivot to the other of said opposed ends of said operating arm for pivoting of said support arm relative to said operating arm through a second vertical plane generally parallel to said first vertical plane and said support arm being connected at its other opposed end to said package carrier member; and means for moving said operating and support arms including means for pivoting said operating arm about said first pivot and means for pivoting said support arm about said second pivot, said operating arm and said support arm pivoting about said first and second pivots, respectively, between a receipt position in which said package carrier member is positioned under the package to be transferred at the winding station for receiving the package at said receipt position and a release position in which said operating arm remains generally stationary and said support arm pivots about said second pivot to laterally withdraw said package carrier member from under the package to release the package onto the package handling assembly.

10. An apparatus for transferring packages according to claim 9 and characterized further by a retractable stop member engagable with said package laterally opposite the direction of to resist lateral and rotational movement of said package as the carrier member is withdrawn and the package is released onto the package handling assembly.

11. An apparatus for transferring packages according to claim 9 in which said package carrier member has an upper generally arcuate concave surface for supporting the package thereon; and said support arm withdraws said carrier member in an arcuate path corresponding generally to the arcuity of the concave surface of the carrier member.

12. An apparatus for transferring packages according to claim 9 and characterized further in that said means for moving said arms move said package carrier member in an arcuate path sequentially upwardly, laterally and downwardly to said release position.

13. An apparatus for transferring packages according to claim 9 and characterized further by means for raising the package at the winding station prior to said positioning of said package carrier member under the package.

14. An apparatus for transferring packages according to claim 13 and characterized further in that said package raising means raises the package to orient the axis of the package in a pre-determined orientation.

15. An apparatus for transferring packages according to claim 13 and characterized further by means for sensing the diameter of the package, said moving means being responsive to said sensing means to adjust the position of said package carrier member under the package in relation to the sensed package diameter to obtain a predetermined spacing between said positioned package carrier member and the raised package.

16. An apparatus for transferring packages according to claim 15 and characterized further in that said moving means includes a drive motor, a drive shaft driven by said motor and driving said moving means, and a rotation counter connected to said drive shaft for counting rotation thereof, and control means responsive to said sensing means and to said rotation counter to control said motor for rotation of said drive shaft to position said package carrier member at a predetermined position relative to the underside of the raised package.

17. An apparatus for transferring packages according to claim 13 and characterized further in that said sensing means includes a pivot arm with a package engaging roller thereon and means for determining the rotational position of said arm when said roller is in engagement with the package.

18. An apparatus for transferring packages according to claim 9 and characterized further by means for adjusting said package carrier member to accommodate the conicity of conical packages.

19. An apparatus for transferring packages according to claim 9 and characterized further in that said moving means includes a gear set mounted on said operating arm, said gear set including a drive gear at the pivot axis of said first pivot operating arm, a driven gear attached for rotation on said operating arm and fixed to said support arm at the axis of said second pivot and an intermediate gear meshing with both said drive gear and said driven gear so that upon rotation of said gear set with said operating arm said intermediate gear orbits on said drive gear and causes reverse rotation of said driven gear sufficient to maintain said support arm in a translational motion.

20. An apparatus for transferring packages according to claim 19 and characterized further in that said drive gear and said driven gear are in a 1 to 1 drive ratio.

21. An apparatus for transferring packages according to claim 19 and characterized further in that said moving means includes means for rotating said drive gear to cause rotation of said driven gear and thereby rotation of said support arm for positioning and withdrawal rotation of said package carrier member.

22. An apparatus for transferring packages according to claim 9 and characterized further in that said package carrier member includes a plurality of rods for support of a package thereon.

23. An apparatus for transferring packages according to claim 9 wherein the textile machine includes a traveling service unit movable along the winding machine and positionable at individual winding stations; and in that said operating arm is pivotally mounted to the traveling service unit at said first pivot.

* * * * *